US009127342B2

(12) United States Patent
Park et al.

(10) Patent No.: US 9,127,342 B2
(45) Date of Patent: Sep. 8, 2015

(54) HIGH-STRENGTH TRANSMISSION GEAR AND METHOD OF MANUFACTURING THE SAME

(71) Applicants: Hyundai Motor Company, Seoul (KR); Kia Motors Corporation, Seoul (KR)

(72) Inventors: Jae Hong Park, Gyeonggi-do (KR); Bong Lae Jo, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 216 days.

(21) Appl. No.: 13/848,211

(22) Filed: Mar. 21, 2013

(65) Prior Publication Data

US 2013/0213527 A1 Aug. 22, 2013

Related U.S. Application Data

(62) Division of application No. 13/323,449, filed on Dec. 12, 2011, now abandoned.

(30) Foreign Application Priority Data

Sep. 19, 2011 (KR) ..... 10-2011-0094132

(51) Int. Cl.
*C23C 8/26* (2006.01)
*C21D 9/32* (2006.01)

(52) U.S. Cl.
CPC .... *C23C 8/26* (2013.01); *C21D 9/32* (2013.01)

(58) Field of Classification Search
CPC ..... C23C 8/26
USPC ..... 148/226
See application file for complete search history.

(56) References Cited

U.S. PATENT DOCUMENTS

| | | | | | |
|---|---|---|---|---|---|
| 4,131,492 | A * | 12/1978 | Fushimi et al. | ..... | 148/217 |
| 2005/0247985 | A1* | 11/2005 | Watanabe et al. | ..... | 257/411 |
| 2010/0193090 | A1* | 8/2010 | Masuda et al. | ..... | 148/622 |

FOREIGN PATENT DOCUMENTS

| | | | | | |
|---|---|---|---|---|---|
| JP | S53-1142 | | | 1/1978 | |
| JP | S53-001142 | | | 1/1978 | |
| JP | 02061032 | A | * | 3/1990 | ..... C22C 38/12 |
| JP | H10-226818 | A | | 8/1998 | |
| JP | 2000-063935 | A | | 2/2000 | |
| JP | 2009-299181 | A | | 12/2009 | |
| KR | 10-1998-034637 | | | 8/1998 | |
| KR | 10-1998-0034637 | A | | 8/1998 | |
| KR | 20020095853 | | * | 12/2002 | |
| KR | 10-2009-0121308 | A | | 11/2009 | |
| KR | 10-2010-0125367 | A | | 11/2010 | |
| WO | 2010-116670 | A1 | | 10/2010 | |

* cited by examiner

*Primary Examiner* — Rebecca Lee
(74) *Attorney, Agent, or Firm* — Mintz Levin Cohn Ferris Glovsky and Popeo, P.C.; Peter F. Corless

(57) ABSTRACT

Disclosed herein is a high-strength transmission gear, manufactured by gas-nitriding a nitriding steel having a composition including iron (Fe) as a main component, 0.25~0.40 wt % of carbon (C), 0.50~1.0 wt % of manganese (Mn), 2.0~3.0 wt % of chromium (Cr), 0.3~1.0 wt % of molybdenum (Mo), 0.2~0.7 wt % of copper (Cu), 0.03~0.1 wt % of niobium (Nb), 0.03~0.1 wt % of aluminum (Al), 0.05~0.15 wt % of vanadium (V), 0.001~0.005 wt % of boron (B) and other inevitable impurities. More specifically, while gas-nitriding of the nitriding steel, the temperature is increased in steps, and the ratio of nitrogen gas in the nitriding steel is decreased in steps.

3 Claims, 4 Drawing Sheets

| Class. | C | Mn | Cr | Cu | Nb | B |
|---|---|---|---|---|---|---|
| CONVENTIONAL CARBURIZED STEEL | 0.17 ~0.23 | 0.55 ~0.90 | 0.85 ~1.25 | ~0.3 | 0.015~ 0.035 | 10~ 30PPM |

PRIOR ART

Fig. 3
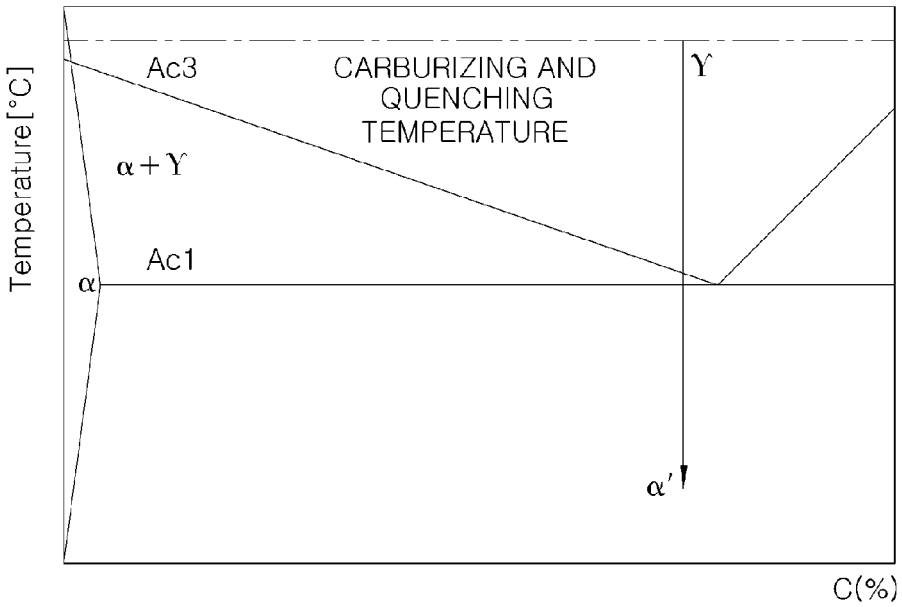
PRIOR ART
Fig. 4
| Class. | C | Mn | Cr | Mo | Cu | Nb | Al | V | B | Fe |
|---|---|---|---|---|---|---|---|---|---|---|
| NITRIDING STEEL | 0.25 ~0.40 | 0.50 ~1.0 | 2.0 ~3.0 | 0.3 ~1.0 | 0.2 ~0.7 | 0.03 ~0.1 | 0.03 ~0.1 | 0.05 ~0.15 | 0.001 ~ 0.005 | REM |
Fig. 5
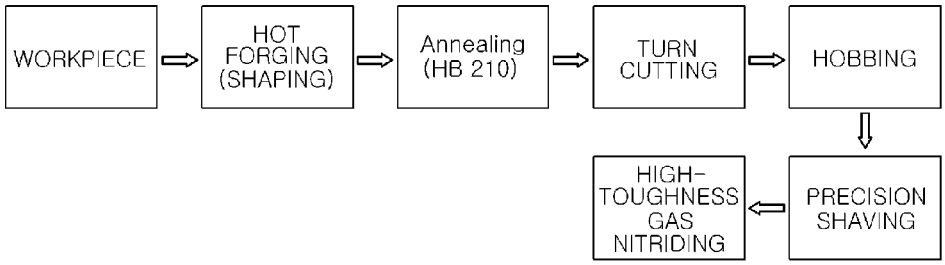

HIGH-STRENGTH TRANSMISSION GEAR AND METHOD OF MANUFACTURING THE SAME

CROSS-REFERENCE TO RELATED APPLICATIONS

This application is a Divisional Application of U.S. patent application Ser. No. 13/323,449, filed Dec. 12, 2011, which claims under 35 U.S.C. §119(a) the benefit of Korean Patent Application No. 10-2011-0094132 filed on Sep. 19, 2011 the entire contents of which are incorporated herein by reference.

BACKGROUND OF THE INVENTION

1. Technical Field

The present invention relates to a high-strength transmission gear manufactured by a phase controlled nitriding treatment of high-strength nitriding steel, and to a method of manufacturing the same.

2. Description of the Related Art

FIG. 1 is a table showing the composition of carburized steel of a conventional transmission gear, FIG. 2 is a schematic diagram showing a process of manufacturing a transmission gear using the carburized steel of FIG. 1, and FIG. 3 is a graph showing the phase change occurring in the process of manufacturing a transmission gear using the carburized steel of FIG. 1.

Currently, transmission gears are generally manufactured by carburizing. Carburized steel having the composition shown in FIG. 1 is generally used as the carburized steel used to manufacture a transmission gear manufactured by the process shown in FIG. 1. In the manufacturing process shown in FIG. 2, both the surface and core of the transmission gear are highly strengthened. However, since the carburizing is conducted at a temperature of 900° C. or above, the transmission gear is often thermally deformed by a phase change as shown in FIG. 3. Here, since the thermal deformation of the transmission gear cannot be easily predicted, the surface of the transmission gear must be grinded down.

Meanwhile, since a transmission gear produced using the above method has a hardness of 700 Hv or more must be grinded in the grinding process, the cost of transmission gears is quite high (about $2.50 per gear) because takes a lot of time (about 5 minutes for each one) to grind the transmission gear. Therefore, a method of manufacturing a high-strength transmission gear without the need to perform the complicated process described above is needed.

It is to be understood that the foregoing description is provided to merely aid the understanding of the present invention, and does not mean that the present invention falls under the purview of the related art which was already known to those skilled in the art.

SUMMARY OF THE INVENTION

Accordingly, the present invention has been devised to solve the above-mentioned problems, and an object of the present invention is to provide a high-strength transmission gear manufactured by a phase-controlled nitriding treatment of high-strength nitriding steel, and a method of manufacturing the same.

In order to accomplish the above object, an aspect of the present invention provides a high-strength transmission gear, manufactured by gas-nitriding a nitriding steel having a composition including iron (Fe) as a main component, 0.25~0.40 wt % of carbon (C), 0.50~1.0 wt % of manganese (Mn), 2.0~3.0 wt % of chromium (Cr), 0.3~1.0 wt % of molybdenum (Mo), 0.2~0.7 wt % of copper (Cu), 0.03~0.1 wt % of niobium (Nb), 0.03~0.1 wt % of aluminum (Al), 0.05~0.15 wt % of vanadium (V), 0.001~0.005 wt % of boron (B) and other inevitable impurities, wherein, in the gas-nitriding of the nitriding steel, temperature is increased in steps, and a ratio of nitrogen gas in the nitriding steel is decreased in steps.

In the gas-nitriding of the nitriding steel, the temperature may be maintained in steps, at 450~500° C. for 4~5 hours, at 480~530° C. for 4~5 hours and at 510~540° C. for 8~10 hours, and the nitrogen gas may be reduced at a ratio of 8~10:4~6:1~2 in steps.

Another aspect of the present invention provides a method of manufacturing a high-strength transmission gear, comprising the steps of: machining a nitriding steel having a composition including iron (Fe) as a main component, 0.25~0.40 wt % of carbon (C), 0.50~1.0 wt % of manganese (Mn), 2.0~3.0 wt % of chromium (Cr), 0.3~1.0 wt % of molybdenum (Mo), 0.2~0.7 wt % of copper (Cu), 0.03~0.1 wt % of niobium (Nb), 0.03~0.1 wt % of aluminum (Al), 0.05~0.15 wt % of vanadium (V), 0.001~0.005 wt % of boron (B) and other inevitable impurities in the shape of a gear; and gas-nitriding the nitriding steel, wherein the nitriding steel is heated in steps and a ratio of nitrogen gas in the nitriding steel is decreased in steps, to form a nitrogen compound layer that provides high toughness to the nitriding steel. Additionally, the nitriding steel may also be hot-forged and annealed as well.

The step of machining the nitriding steel may include turn cutting, hobbing, quenching/tempering (Q/T), and finish cutting. Furthermore, while gas-nitriding the nitriding steel, the temperature may be maintained in steps, at 450~500° C. for 4~5 hours, at 480~530° C. for 4~5 hours and at 510~540° C. for 8~10 hours, and the nitrogen gas may be reduced at a ratio of 8~10:4~6:1~2 in steps.

BRIEF DESCRIPTION OF THE DRAWINGS

The above and other objects, features and advantages of the present invention will be more clearly understood from the following detailed description taken in conjunction with the accompanying drawings, in which:

FIG. 3 is a graph showing the phase change occurring in the process of manufacturing a transmission gear using the carburized steel of FIG. 1;

FIG. 4 is a view showing the composition of nitriding steel for manufacturing a high-strength transmission gear according to an exemplary embodiment of the present invention;

FIG. 5 is a view showing a process of manufacturing a transmission gear using the nitriding steel of FIG. 4;

DESCRIPTION OF THE PREFERRED EMBODIMENTS

Hereinafter, preferred embodiments of the present invention will be described in detail with reference to the attached drawings.

Figures 1, 2:
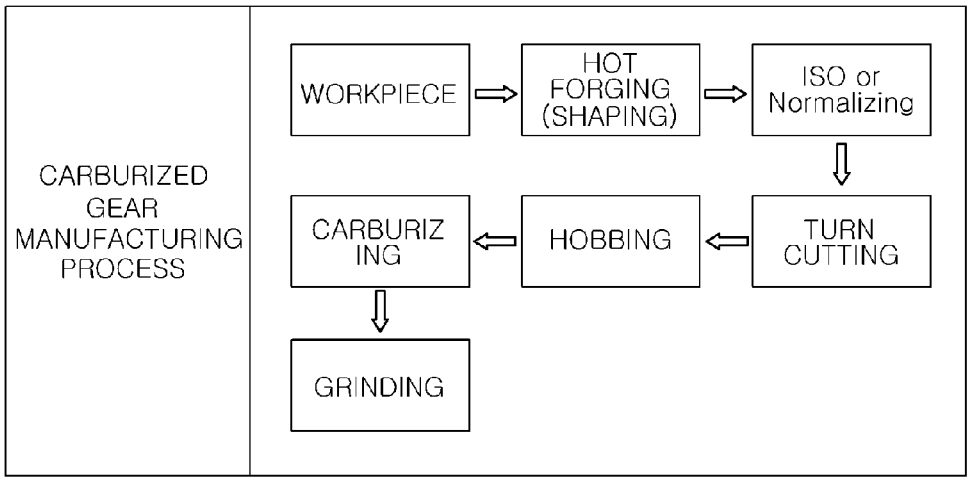
PRIOR ART Fig. 2
FIG. 1 is a view showing the composition of carburized steel of a conventional transmission gear.
FIG. 2 is a view showing a process of manufacturing a transmission gear using the carburized steel of FIG. 1.
Figure 6:
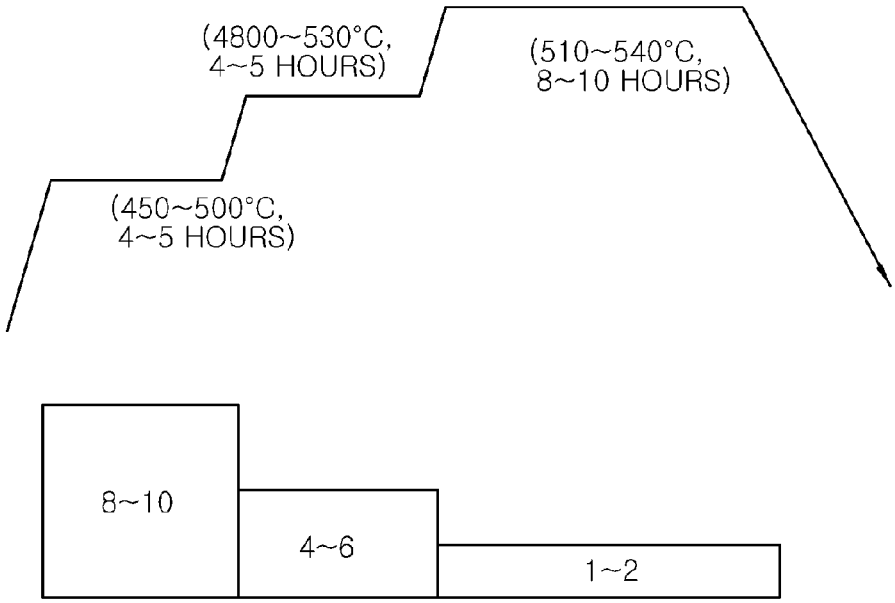
FIG. 6 is a view showing a gas nitriding process for providing high-toughness to the nitriding steel of FIG. 4.
Figure 7:
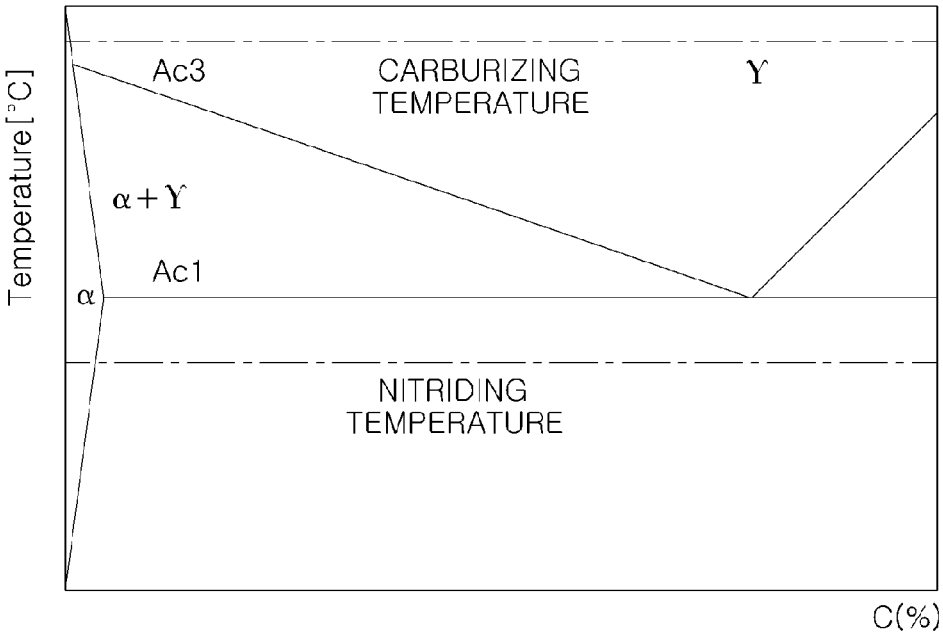
FIG. 7 is a graph showing the phase change occurring in the process of manufacturing a transmission gear using the nitriding steel of FIG. 4.

FIG. 4 is a table showing the composition of nitriding steel for manufacturing a high-strength transmission gear according to an exemplary embodiment of the present invention, FIG. 5 is a schematic diagram showing a process of manufacturing a transmission gear using the nitriding steel of FIG. 4, and FIG. 6 is a graph showing a gas nitriding process for manufacturing a high-toughness transmission gear using the nitriding steel of FIG. 4.

The high-strength transmission gear according to the present invention is manufactured by gas-nitriding a nitriding steel having a composition including iron (Fe) as a main component, 0.25~0.40 wt % of carbon (C), 0.50~1.0 wt % of manganese (Mn), 2.0~3.0 wt % of chromium (Cr), 0.3~1.0 wt % of molybdenum (Mo), 0.2~0.7 wt % of copper (Cu), 0.03~0.1 wt % of niobium (Nb), 0.03~0.1 wt % of aluminum (Al), 0.05~0.15 wt % of vanadium (V), 0.001~0.005 wt % of boron (B) and other inevitable impurities, wherein, in the gas-nitriding of the nitriding steel, the temperature is increased in steps, and a ratio of nitrogen gas in the nitriding steel is decreased in steps.

Here, in the gas-nitriding of the nitriding steel, temperature may be maintained in steps, at 450~500° C. for 4~5 hours, at 480~530° C. for 4~5 hours and at 510~540° C. for 8~10 hours, and the nitrogen gas may be reduced at a ratio of 8~10:4~6:1~2 in steps. The composition of the nitriding steel used to manufacture the high-strength transmission gear of the present invention is shown in FIG. 4.

More specifically, 1) Carbon (C) is an element necessary to secure strength, and is included in an amount of 0.25 wt % or more. However, when a large amount of carbon (C) is added, toughness is deteriorated, and workability is deteriorated. Therefore, the amount of carbon (C) is limited to 0.4 wt % or less.

2) Manganese (Mn) is an element improving strength and hardenability, and is included in an amount of 0.5 wt % or more. However, when a large amount of manganese (Mn) is added, the formation of a nitrogen compound layer is inhibited, and workability is deteriorated. Therefore, the amount of manganese (Mn) is limited to 1.0 wt % or less.

3) Chromium (Cr) is an element improving surface hardness and increasing nitriding depth, and is included in an amount of 2.0 wt % or more. However, when a large amount of chromium (Cr) is added, hardness is increased, and thus cold workability is deteriorated. Therefore, the amount of chromium (Cr) is limited to 3.0 wt % or less.

4) Molybdenum (Mo), like chromium (Cr), is a major element increasing surface hardness and hardening depth after nitriding. Further, molybdenum (Mo) increases hardenability to obtain a martensite structure. Molybdenum (Mo) is included in an amount of 0.3 wt % or more. However, when a large amount of molybdenum (Mo) is added, hardness is increased, and thus cold workability is deteriorated. Further, molybdenum (Mo) is an expensive element. Therefore, the amount of molybdenum (Mo) is limited to 1.0 wt % or less.

5) Copper (Cu) is an element serving to prevent softening during nitriding, and is included in an amount of 0.2 wt % or more. However, when a large amount of copper (Cu) is added, surface defects are caused during hot rolling. Therefore, the amount of copper (Cu) is limited to 0.7 wt % or less.

6) Niobium (Nb) is a major element in atomizing steel, and serves to increase hardening depth during nitriding. Niobium (Nb) is included in an amount of 0.03 wt % or more. However, when niobium (Nb) is included in an amount of 0.1 wt % or more, it is saturated in the composition, and thus effects do not occur. Further, niobium (Nb) is an expensive element. Therefore, the amount of niobium (Nb) is limited to 1.0 wt % or less.

7) Aluminum (Al) is a major element in forming nitride, and serves to improve surface hardness. Aluminum (Al) is included in an amount of 0.03 wt % or more. However, aluminum (Al) produces a bad influence on the increase of hardening depth. Therefore, the amount of aluminum (Al) is limited to 0.1 wt % or less.

8) Vanadium (V), like Niobium (Nb), is a major element in atomizing steel, and serves to increase hardening depth during nitriding. Vanadium (V) is included in an amount of 0.05 wt % or more. However, when vanadium (V) is included in an amount of 0.15 wt % or more, toughness and workability are deteriorated. Further, vanadium (V) is an expensive element. Therefore, the amount of vanadium (V) is limited to 0.15 wt % or less.

9) Boron (B) serves to improve hardenability even when it is added in small amounts. Thus, boron (B) is included in an amount of 0.001 wt % or more. However, when a large amount of boron (B) is added, it is saturated in the composition, and thus effects do not occur. Therefore, the amount of niobium (Nb) is limited to 0.005 wt % or less.

Meanwhile, the method of manufacturing a high-strength transmission gear according to the present invention includes the steps of: machining a nitriding steel having a composition including iron (Fe) as a main component, 0.25~0.40 wt % of carbon (C), 0.50~1.0 wt % of manganese (Mn), 2.0~3.0 wt % of chromium (Cr), 0.3~1.0 wt % of molybdenum (Mo), 0.2~0.7 wt % of copper (Cu), 0.03~0.1 wt % of niobium (Nb), 0.03~0.1 wt % of aluminum (Al), 0.05~0.15 wt % of vanadium (V), 0.001~0.005 wt % of boron (B) and other inevitable impurities in the shape of a gear; and gas-nitriding the nitriding steel, wherein the nitriding steel is heated in steps and a ratio of nitrogen gas in the nitriding steel is decreased in steps, to form a nitrogen compound layer that provides high toughness to the nitriding steel. Additionally, the method may further include hot-forging and then annealing the nitriding steel.

While machining the nitriding steel turn cutting, hobbing, quenching/tempering (Q/T), and finish cutting may also be performed. Furthermore, during gas-nitriding the nitriding steel, the temperature may be maintained in steps, at 450~500° C. for 4~5 hours, at 480~530° C. for 4~5 hours and at 510~540° C. for 8~10 hours, and the nitrogen gas may be reduced at a ratio of 8~10:4~6:1~2 in steps.

The method of manufacturing a high-strength transmission gear according to the present invention is shown in FIG. 5. Here, as shown in FIG. 6, the gas-nitriding may be conducted in steps at 450~500° C. for 4~5 hours, at 480~530° C. for 4~5 hours and at 510~540° C. for 8~10 hours, and the nitrogen gas may be reduced at a ratio of 8~10:4~6:1~2 in steps.

Since a transmission gear is a part that is subject to high load, a compound layer easily breaks when general gas nitriding is conducted. Therefore, gas nitriding for providing high toughness must be applied.

Since the gas nitriding for providing high toughness is conducted in steps according to temperature while introducing nitrogen gas into a furnace in steps, a nitrogen compound layer, which is stable compared to the nitrogen compound layer formed by general gas nitriding in which a large amount of nitrogen gas is introduced into the furnace at once during a conventional nitriding process, can be formed (refer to FIG. 5). Further, when this gas nitriding for providing high toughness is used, heat treatment is conducted at low temperatures compared to conventional carburizing as shown in FIG. 6. Therefore, hardly any thermal deformation occurs after heat treatment, and thus additional machining processes can be omitted after heat treatment.

As described above, according to the high-strength transmission gear having the above structure and the manufacturing method thereof, this high-strength transmission gear can be used as a substitute for a carburized transmission gear because its surface hardness and hardening depth are equal to those of the transmission gear manufactured by carburizing. Further, thermal deformation occurring during carburizing can be prevented, so that dimensional accuracy can be increased, thereby reducing the noise from a transmission gear. Also, a nitrogen compound layer, which is stable compared to the nitrogen compound layer formed by a conventional nitriding process, is formed, so that it is possible to prevent the nitrogen compound layer from being separated from a transmission gear, thereby increasing the wear resistance of the transmission gear. Finally, a grinding process can be omitted after the carburizing process is performed, thus reducing the manufacturing cost of a transmission gear.

Figure 8:
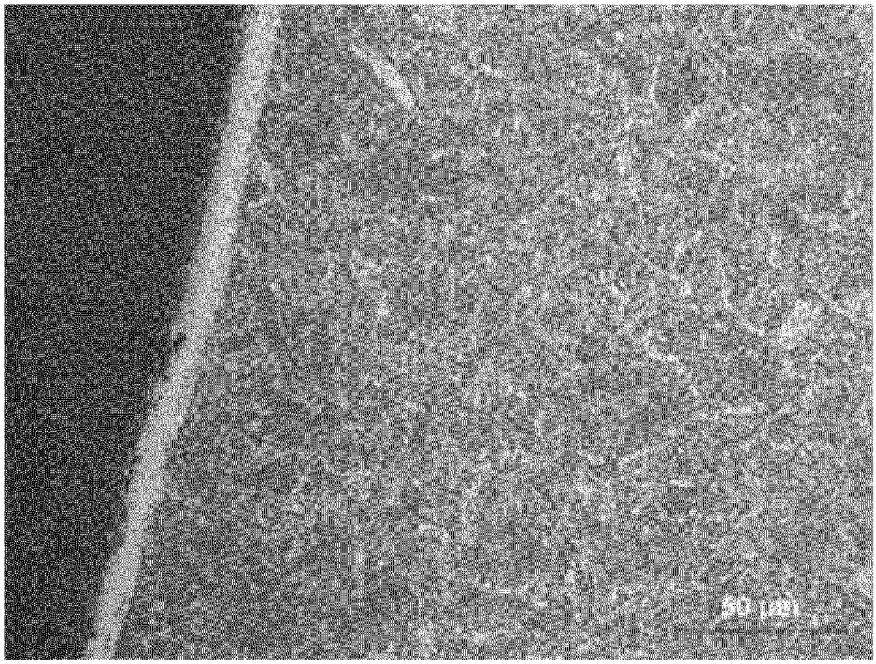
FIG. 8 is a photograph showing the microstructure of the surface of the transmission gear of the present invention.

High-strength transmission gears experimentally manufactured using the technology of the present invention. As a result, as shown in FIG. 8, a stable compound layer, from the surface of which a nitrided compound layer was not separated, could be obtained.

Further, as given in Table 1 below, it can be ascertained that the surface hardness and hardening depth of the transmission gear of the present invention are equal to those of the transmission gear manufactured by carburizing, and that the surface hardness and hardening depth of the transmission gear of the present invention is improved compared to those of the transmission gear manufactured by a conventional nitriding process.

TABLE 1

| Class. | Surface hardness | Hardening depth | Core hardness |
|---|---|---|---|
| Example | Hv 850~880 | 0.5 mm | Hv 300 |
| Carburizing | Hv 710~760 | 0.6 mm | Hv 400 |
| Nitriding | Hv 650~690 | 0.4 mm | Hv 180 |

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of manufacturing a high-strength transmission gear, comprising the steps of:

machining a nitriding steel having a composition including iron (Fe) as a main component, 0.25~0.40 wt % of carbon (C), 0.50~1.0 wt % of manganese (Mn), 2.0~3.0 wt % of chromium (Cr), 0.3~1.0 wt % of molybdenum (Mo), 0.2~0.7 wt % of copper (Cu), 0.03~0.1 wt % of niobium (Nb), 0.03~0.1 wt % of aluminum (Al), 0.05~0.15 wt % of vanadium (V), 0.001~0.005 wt % of boron (B) and other inevitable impurities in a shape of a gear; and gas-nitriding the nitriding steel, wherein the nitriding steel is heated in steps and a ratio of nitrogen gas in the nitriding steel is decreased in steps, to form a nitrogen compound layer that provides high toughness to the nitriding steel, wherein, while gas-nitriding the nitriding steel, the temperature is maintained in steps at 450~500° C., for 4~5 hours, at 480~530° C. for 4~5 hours and at 510~540° C. for 8~10 hours, and the nitrogen gas is reduced at a ratio of 8~10:4~6:1~2 in steps.

2. The method of manufacturing a high-strength transmission gear according to claim 1, further comprising hot-forging and then annealing the nitriding steel.

3. The method of manufacturing a high-strength transmission gear according to claim 2, wherein machining the nitriding steel includes turn cutting, hobbing, quenching and tempering and finish cutting.

* * * * *